US009997859B2

(12) United States Patent
Yu

(10) Patent No.: US 9,997,859 B2
(45) Date of Patent: Jun. 12, 2018

(54) ELECTRICAL CONNECTOR HAVING A FIRMLY SECURED FRONT SEALING MEMBER

(71) Applicant: FOXCONN INTERCONNECT TECHNOLOGY LIMITED, Grand Cayman (KY)

(72) Inventor: Yang-Yang Yu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/647,287

(22) Filed: Jul. 12, 2017

(65) Prior Publication Data

US 2018/0019534 A1 Jan. 18, 2018

(30) Foreign Application Priority Data

Jul. 12, 2016 (CN) ..... 2016 2 0728966 U

(51) Int. Cl.

| | |
|---|---|
| ***H01R 13/52*** | (2006.01) |
| ***H01R 13/436*** | (2006.01) |
| ***H01R 13/627*** | (2006.01) |
| ***H01R 4/24*** | (2018.01) |
| *H01R 13/74* | (2006.01) |

(52) U.S. Cl.

CPC ..... *H01R 13/4368* (2013.01); *H01R 4/2454* (2013.01); *H01R 13/6276* (2013.01); *H01R 13/5219* (2013.01); *H01R 13/743* (2013.01)

(58) Field of Classification Search

CPC ..... H01R 13/5202; H01R 13/5205; H01R 13/5219; H01R 13/5221; H01R 33/965; H01R 13/52

USPC ..... 439/271, 587

See application file for complete search history.

(56) References Cited

U.S. PATENT DOCUMENTS

| | | | | |
|---|---|---|---|---|
| 9,478,998 | B1 * | 10/2016 | Lapetina | H02J 7/0042 |
| 2012/0190228 | A1 * | 7/2012 | Lee | H01R 13/7172 439/271 |
| 2013/0183844 | A1 * | 7/2013 | Wang | H01R 24/68 439/271 |
| 2014/0113497 | A1 * | 4/2014 | Wang | H01R 13/52 439/660 |

(Continued)

FOREIGN PATENT DOCUMENTS

| | | |
|---|---|---|
| CN | 204927628 U | 12/2015 |
| CN | 205016762 U | 2/2016 |

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector includes: an insulative housing having a base portion and a tongue portion; plural contacts affixed to the insulative housing and exposed to the tongue portion; a shielding shell enclosing the insulative housing and having a front end; an outer cover enclosing the shielding shell and having a front protrusion; and a front sealer having a front main body, a rear securing portion, and a pair of connecting portions connected between the front main body and the rear securing portion; wherein a groove is defined between the front end of the shielding shell and the front protrusion of the outer cover; and the front main body is disposed in the groove and the rear securing portion is disposed behind the front protrusion of the outer cover.

16 Claims, 11 Drawing Sheets

(56) References Cited

U.S. PATENT DOCUMENTS

| | | | | |
|---|---|---|---|---|
| 2014/0308833 | A1* | 10/2014 | Fukami | B29C 70/72 439/271 |
| 2015/0270646 | A1* | 9/2015 | Kao | H01R 13/6581 439/76.1 |
| 2015/0270661 | A1* | 9/2015 | Kao | H01R 13/5202 439/271 |
| 2018/0019547 | A1* | 1/2018 | Maesoba | H01R 13/648 |

* cited by examiner

ELECTRICAL CONNECTOR HAVING A FIRMLY SECURED FRONT SEALING MEMBER

BACKGROUND OF THE INVENTION

1. Field of the Invention

The present invention relates to an electrical connector including a front sealing member disposed in a groove defined between a shielding shell and an outer cover thereof, and in particular to such sealing member having a firmly secured rear portion.

2. Description of Related Arts

China Patent No. 205016762 discloses an electrical connector including an insulative housing, a plurality of conductive terminals secured to the insulative housing, a metal shell enclosing the insulative housing, an outer cover enclosing the metal shell and having a peripheral recess, and a sealing member or sealer attached to the recess with the aid of an adhesive. However, the adhesive may lose its property after repeated use and affect the waterproof function of the sealer.

An electrical connector having an improved sealer is desired.

SUMMARY OF THE INVENTION

An electrical connector comprises: an insulative housing having a base portion and a tongue portion; plural contacts affixed to the insulative housing and exposed to the tongue portion; a shielding shell enclosing the insulative housing and having a front end; an outer cover enclosing the shielding shell and having a front protrusion; and a front sealer having a front main body, a rear securing portion, and a pair of connecting portions connected between the front main body and the rear securing portion; wherein a groove is defined between the front end of the shielding shell and the front protrusion of the outer cover; and the front main body is disposed in the groove and the rear securing portion is disposed behind the front protrusion of the outer cover.

DETAILED DESCRIPTION OF THE PREFERRED EMBODIMENT

Figure 1:
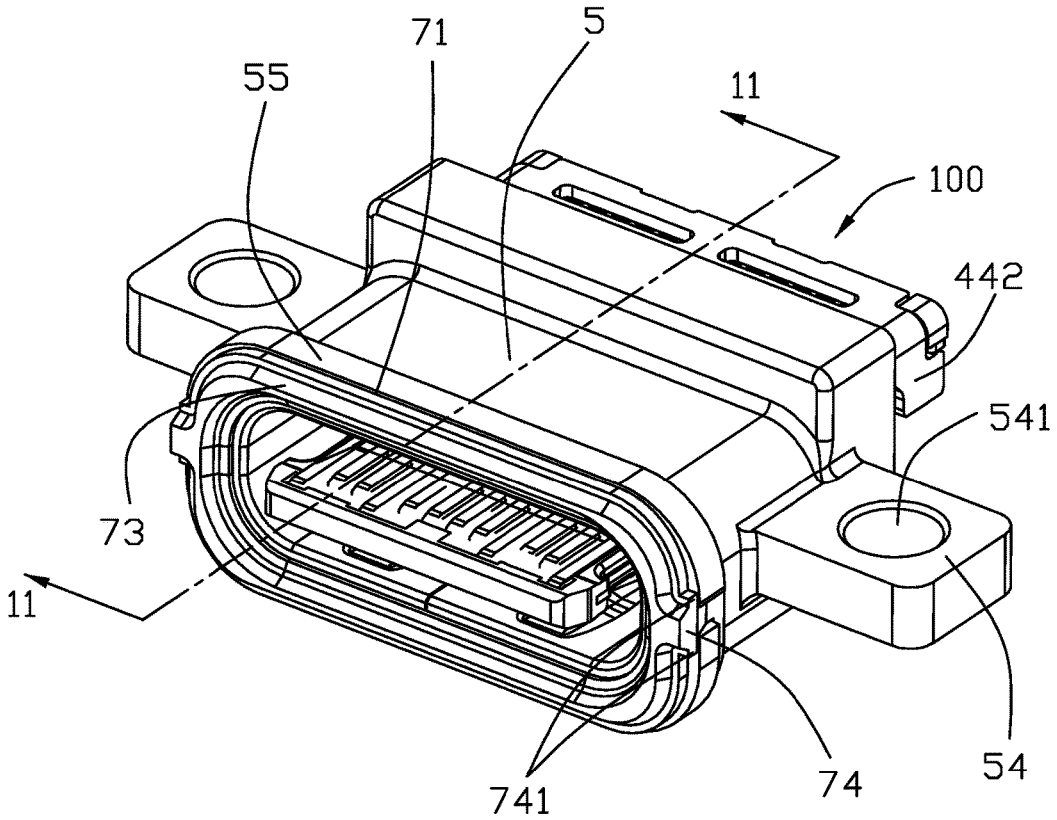
FIG. 1 is a perspective view of an electrical connector in accordance with the present invention.
Figure 2:
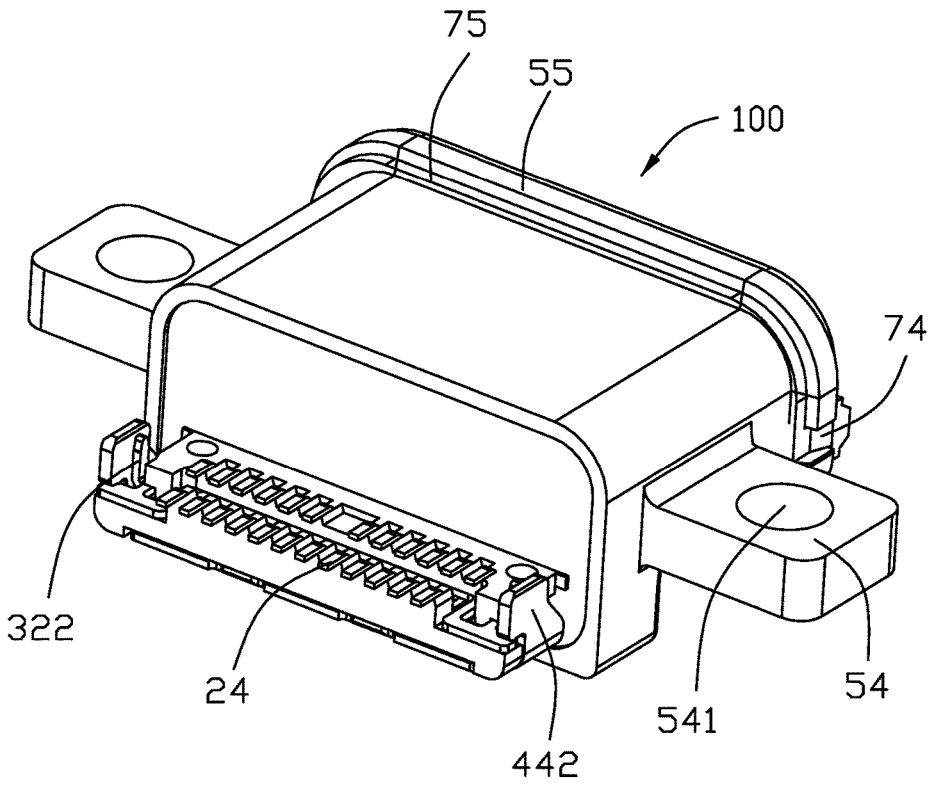
FIG. 2 is a further perspective view of the electrical connector.
Figure 3:
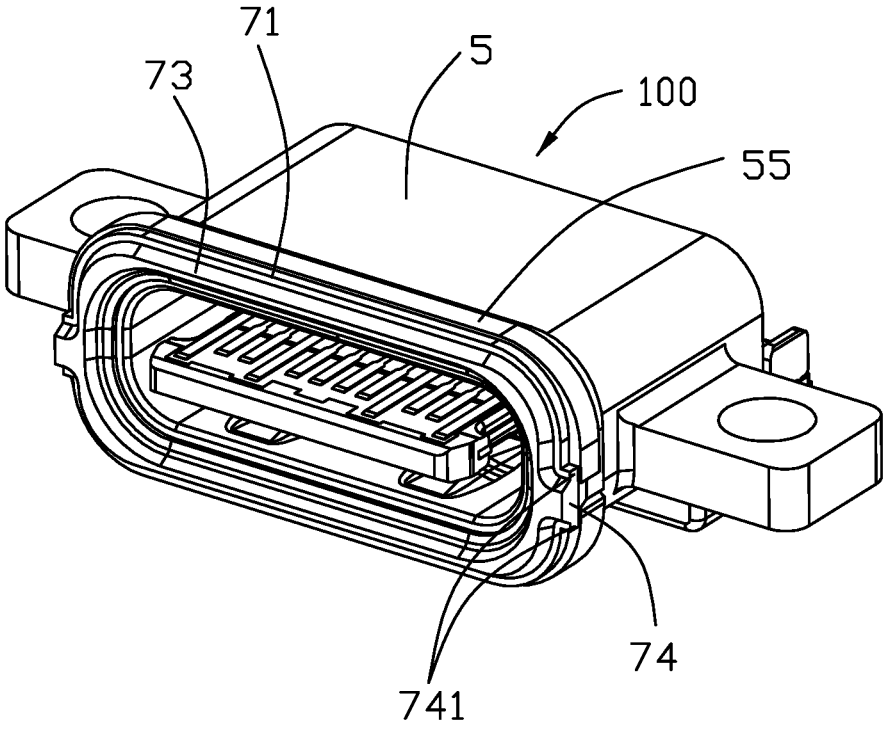
FIG. 3 is another perspective view of the electrical connector.

Referring to FIGS. 1 to 10, an electrical connector 100 includes an insulative housing 1, a plurality of contacts 2 affixed to the insulative housing 1, a shielding shell 4 enclosing the insulative housing 1, an outer cover 5 enclosing the shielding shell 4, and a front sealer 7. The electrical connector 100 may further include a rear sealer 6. The insulative housing 1, the plurality of contacts 2, and the shielding shell 4 constitute a receptacle connector 200. The receptacle connector 200 may further include a middle shielding plate 3.

Referring to FIGS. 7-10, the insulative housing 1 includes a base portion 11 and a tongue portion 12 extending forwardly from the base portion 11. The base portion 11 includes a pair of receiving grooves 153 depressed downwardly from an upper surface thereof, a pair of recesses 154 depressed upwardly from a lower surface thereof, and a notch 148 located at a rear end of recesses 154 and depressed upwardly. The insulative housing 1 further includes a first insulator 13, a second insulator 14, a third insulator 15, and a pair of posts 16. The first insulator 13 includes a first base 131 and a first tongue 132 extending forwardly from the first base 131. The first base 131 includes a holding block 133, a pair of first locking portions 134 on both sides of a rear end of the holding block 133, and a pair of first mated holes 135 located at the front end of first locking portions 134. The first tongue 132 includes a locking hole 136 located at a front end thereof. The second insulator 14 includes a second base 141 and a second tongue 142 extending forwardly from the second base 141. The second base 141 includes a pair of second locking portions 143 located at a rear end thereof and extending upwardly from an upper surface thereof, a pair of second mated holes 144 located at a front end of second locking portions 143, a pair of stopper barriers 145 located at a front end of second mated holes 144 and extending upwardly, the notch 148 depressed upwardly from a lower surface thereof, and a pair of engaging grooves 149 at rear side surfaces thereof. The pair of stopper barriers 145 are enclosed to form a receiving space 146. The second tongue 142 includes a clamping block 147 located at a front end thereof and extending upwardly. The third insulator 15 includes a third base 151 and a third tongue 152 extending forwardly from the third base 151. The third base 151 includes the pair of receiving grooves 153 located at an upper surface thereof, and the pair of recesses 154 located at a lower surface thereof. The third tongue 152 includes a hollow section 155 and a pair of fixed grooves 156 on both sides.

The plurality of contacts 2 includes a row of upper contacts 21 and a row of lower contacts 22. Each of the upper contacts 21 and the lower contacts 22 includes a contacting portion 23, a tail 24, and a securing portion 25 connecting the contacting portion 23 and the tail 24. The upper contacts 21 and lower contacts 22 are equal in number. Each contacting portion 23 of the upper contacts 21 is positioned in reverse symmetry with respect to a respective one of the lower contacts 22.

The metal shielding plate 3 includes a front portion 31, a rear portion 32, and a connecting portion 33. The connecting portion 33 includes a through hole 34 in the middle thereof. The rear portion 32 comprises a pair of fixed pins 321 located at a rear end thereof and extending to both sides, a pair of soldering pins 322 located at a front end of fixed pins 321 and bending downwardly, a pair of positioning holes 323, and a pair of third mated holes 324 located in front of the positioning holes 323.

Figure 7:
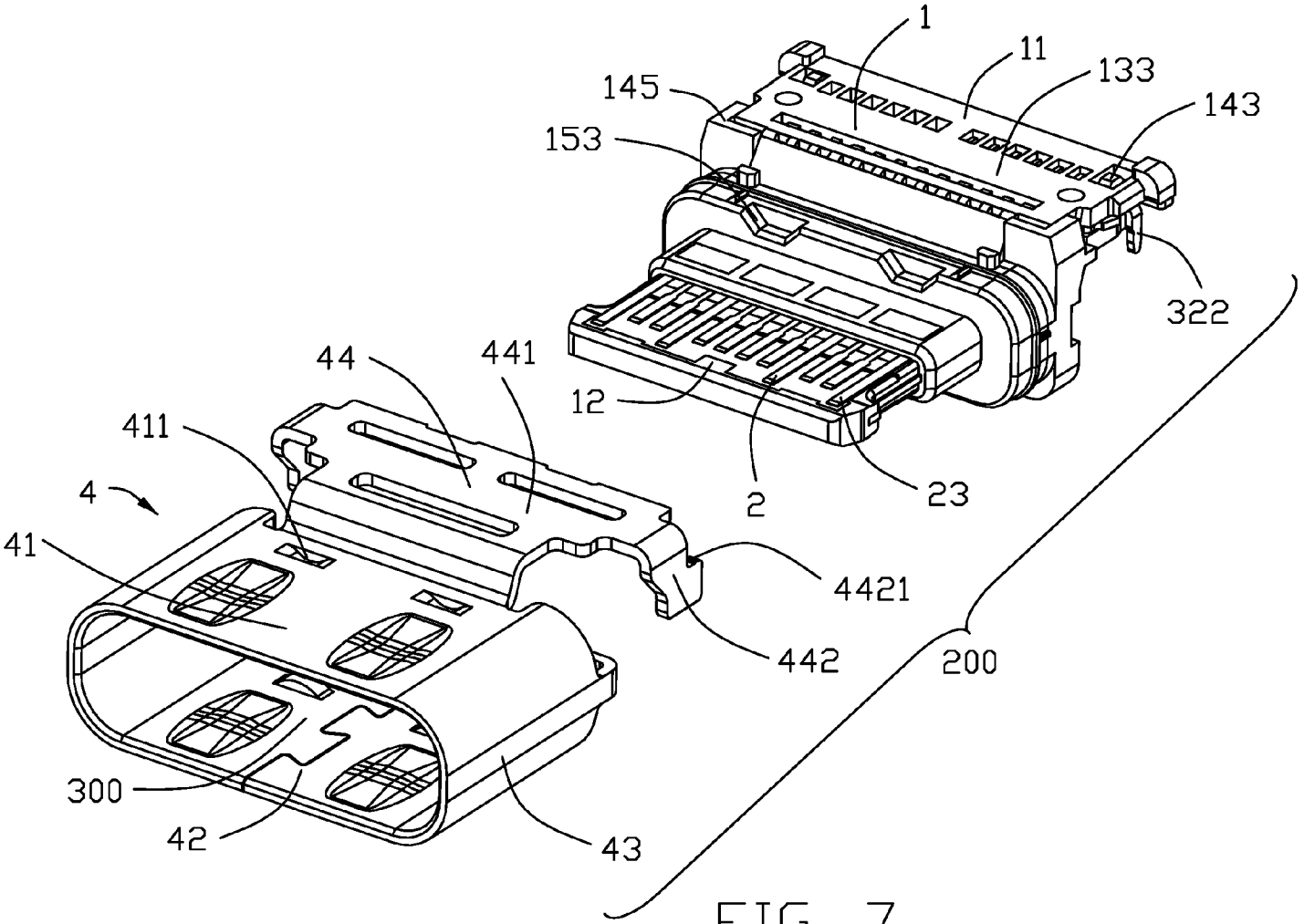
FIG. 7 is an exploded view of a contact module and a shielding shell of the electrical connector in FIG. 5.
Figure 8:
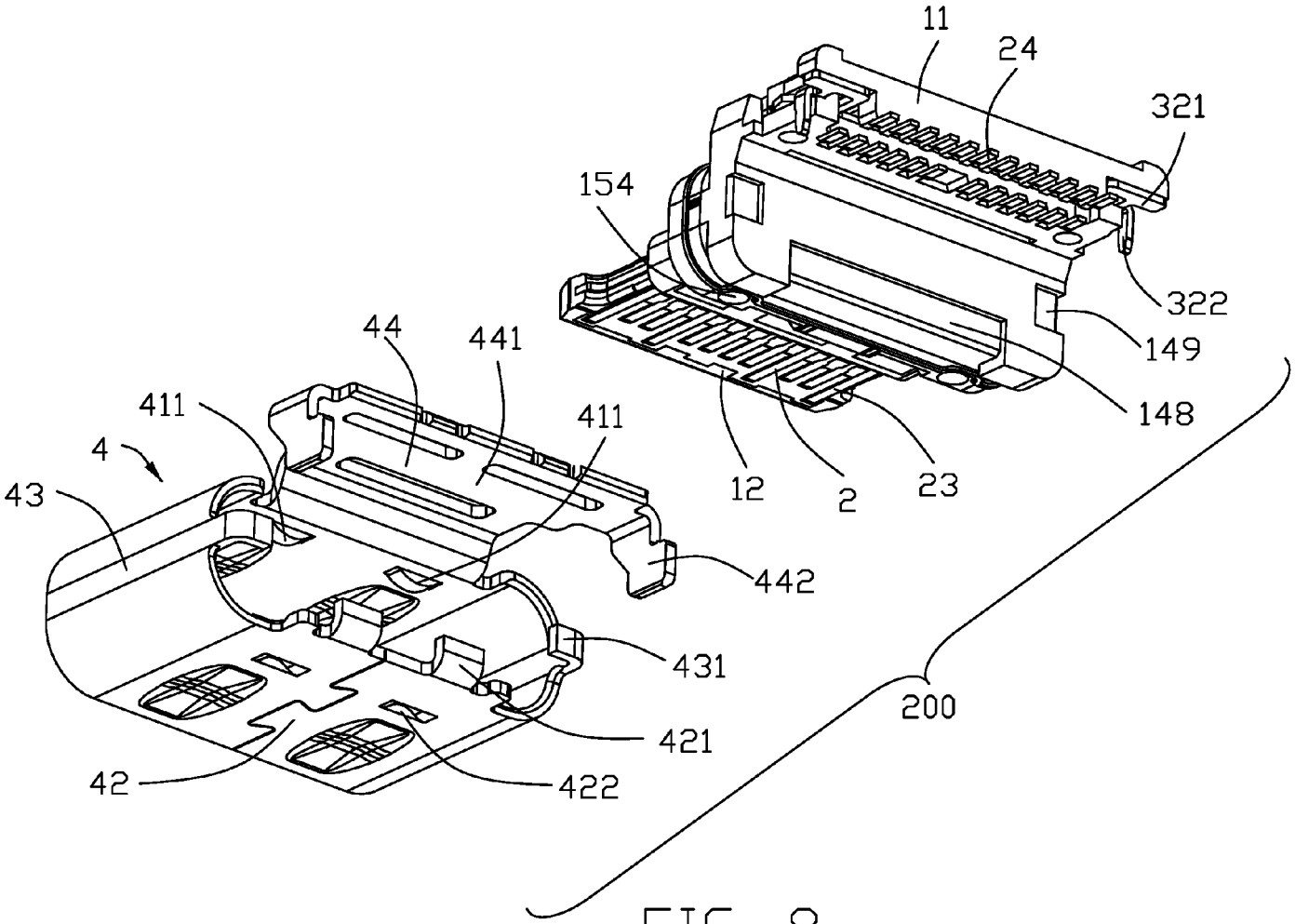
FIG. 8 is a view similar to FIG. 7 but from another perspective.

Referring to FIGS. 7-8, the shielding shell 4 includes an upper wall 41, a lower wall 42 opposite to the upper wall 41, and a pair of lateral walls 43 connecting the upper wall 41 and the lower wall 42 for forming a receiving room 300. The shielding shell 4 further includes a shielding sheet 44 extending rearward from a rear end of the upper wall 41. The upper wall 41 includes a pair of first protrusions 411 located at a rear end thereof. The lower wall 42 includes a pair of first bending parts 421 located at a rear end thereof and bending upwardly, and a pair of second protrusions 422 located at a front end of the pair of first bending parts 421. The lateral walls 43 include a pair of second bending parts 431 located at a rear end thereof and bent inwardly. The shielding sheet 44 includes a main portion 441 and a pair of fixed legs 442 extending downward from both sides of the main portion 441. Each fixed leg has a supporting portion 4421.

Figure 5:
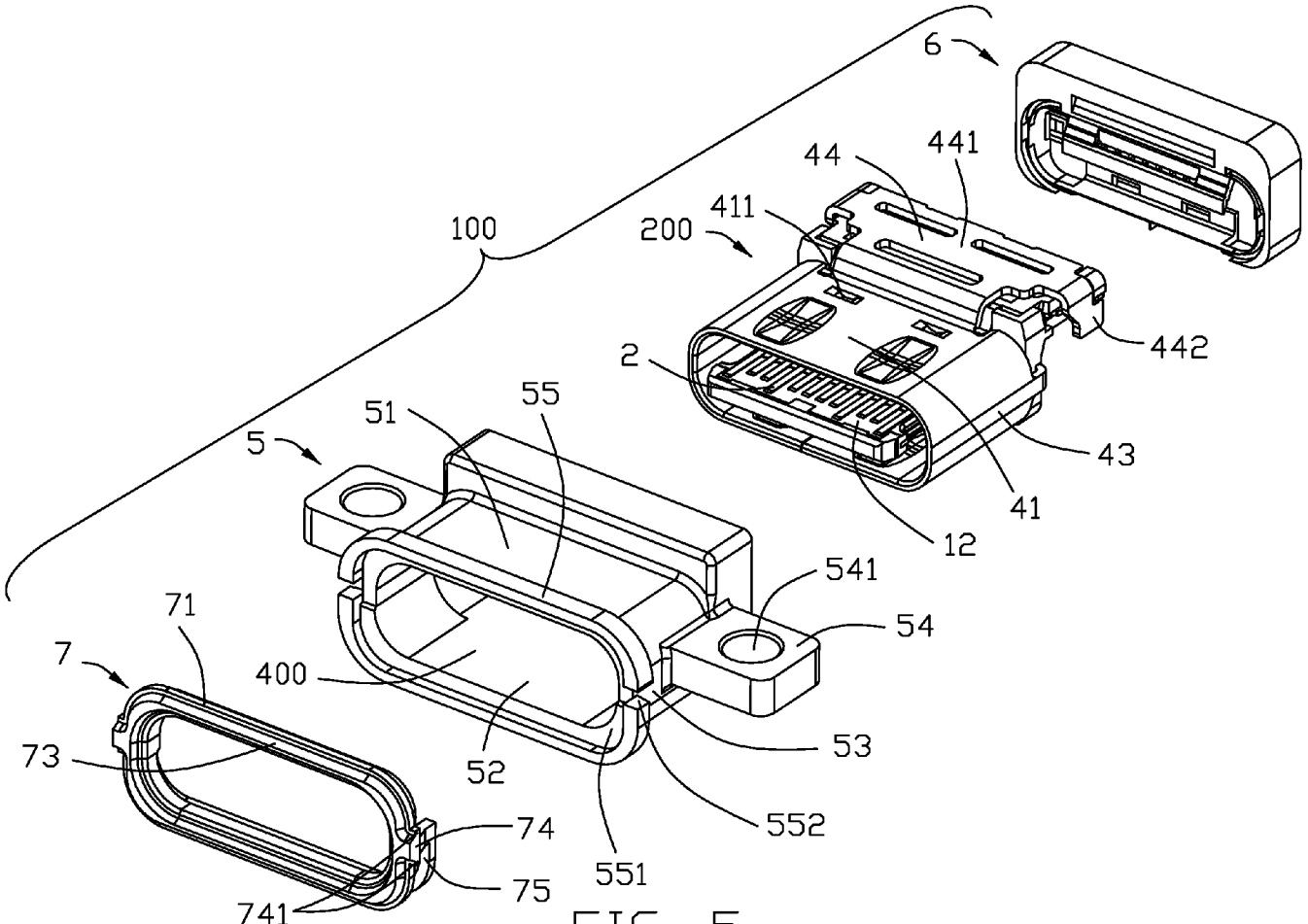
FIG. 5 is an exploded view of the electrical connector in FIG. 1.
Figure 6:
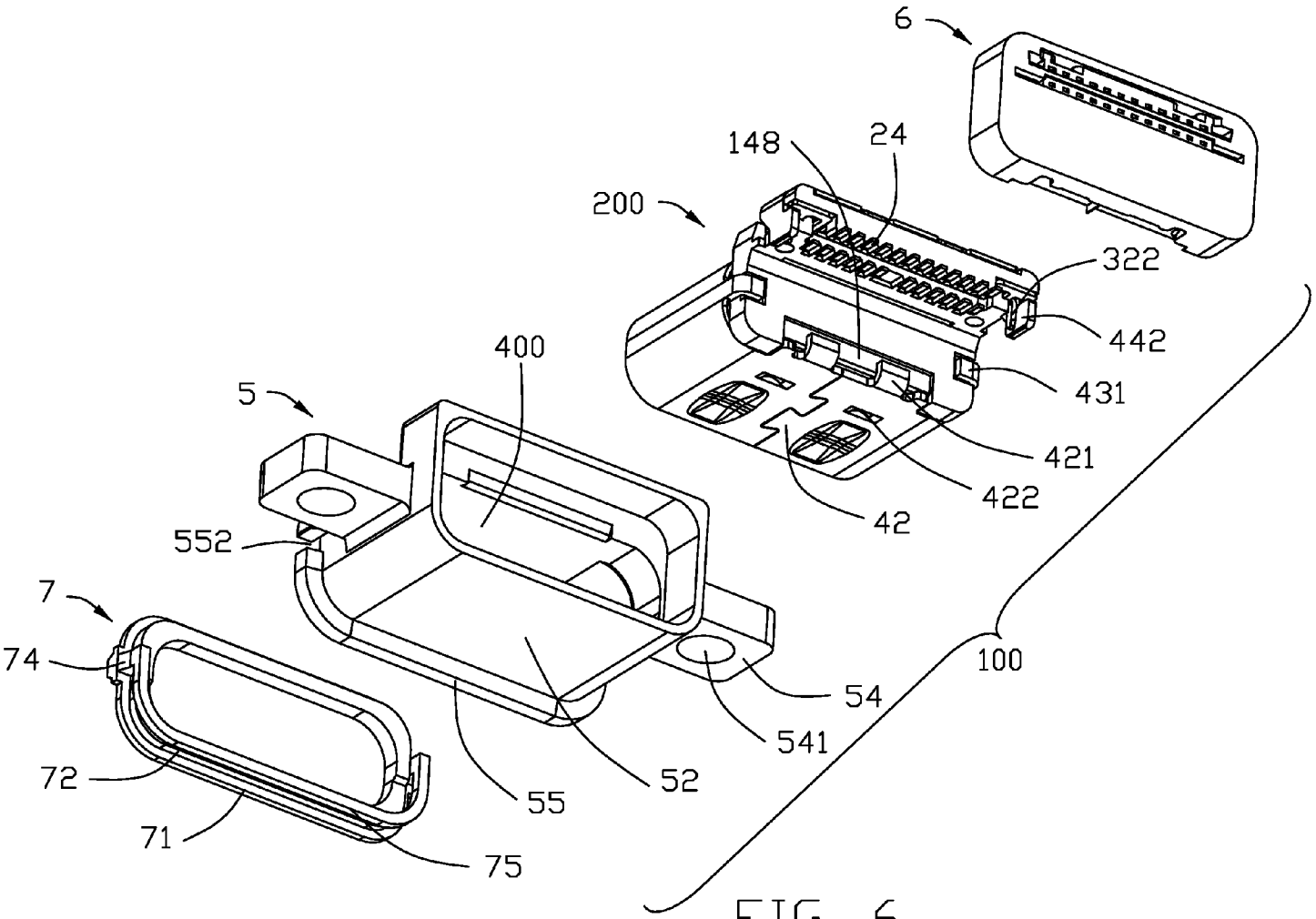
FIG. 6 is a view similar to FIG. 5 but from another perspective.

Referring to FIGS. 5-6, the outer cover 5 includes an upper plate 51, a lower plate 52 opposite to the upper plate 51, a pair of lateral plates 53 connecting the upper plate 51 and the lower plate 52 for forming a mating room 400, and a pair of fixing lugs 54 extending outward from the lateral plates 53. Each fixing lug 54 has a through hole 541. The outer cover 5 has a front protrusion 55. The front protrusion 55 of the outer cover 5 has a pair of slots 552.

The sealer 7 includes a front main body, constituted by a base part 71, a front first part 72, and a rear second part 73 in the embodiment shown, a rear securing portion 75, and a pair of connecting portions 74 connected between the front main body and the rear securing portion 75. The front main body is annular and the rear securing portion 75 is U-shaped. If desired, the rear securing portion 75 may also be annular. The connecting portion 74 has an enlarged section 741 greater in size than the slot 552 in order to abut against a front surface of the protrusion 55. The rear securing portion 75 is spaced from the front first part 72.

Figure 9:
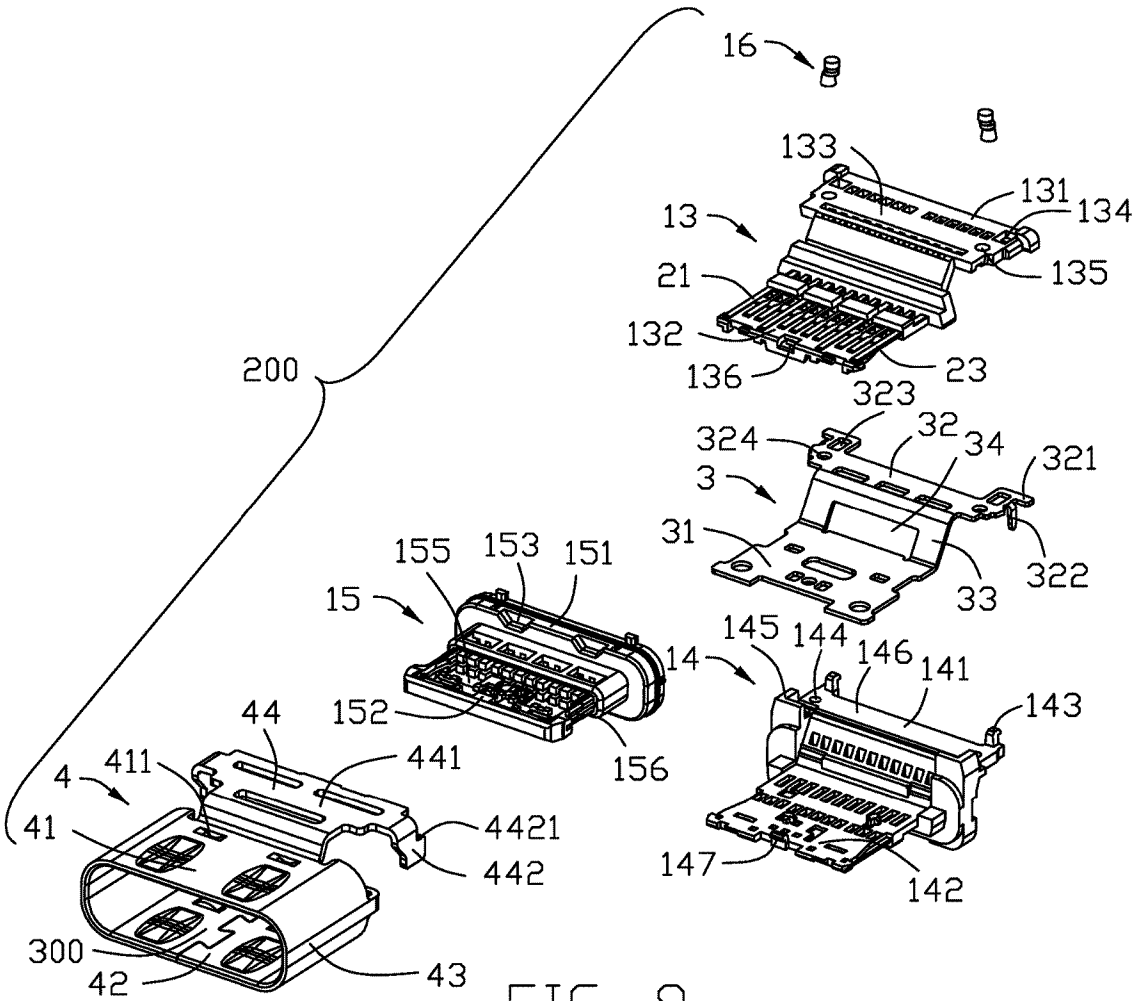
FIG. 9 is a further exploded view of FIG. 7.
Figure 10:
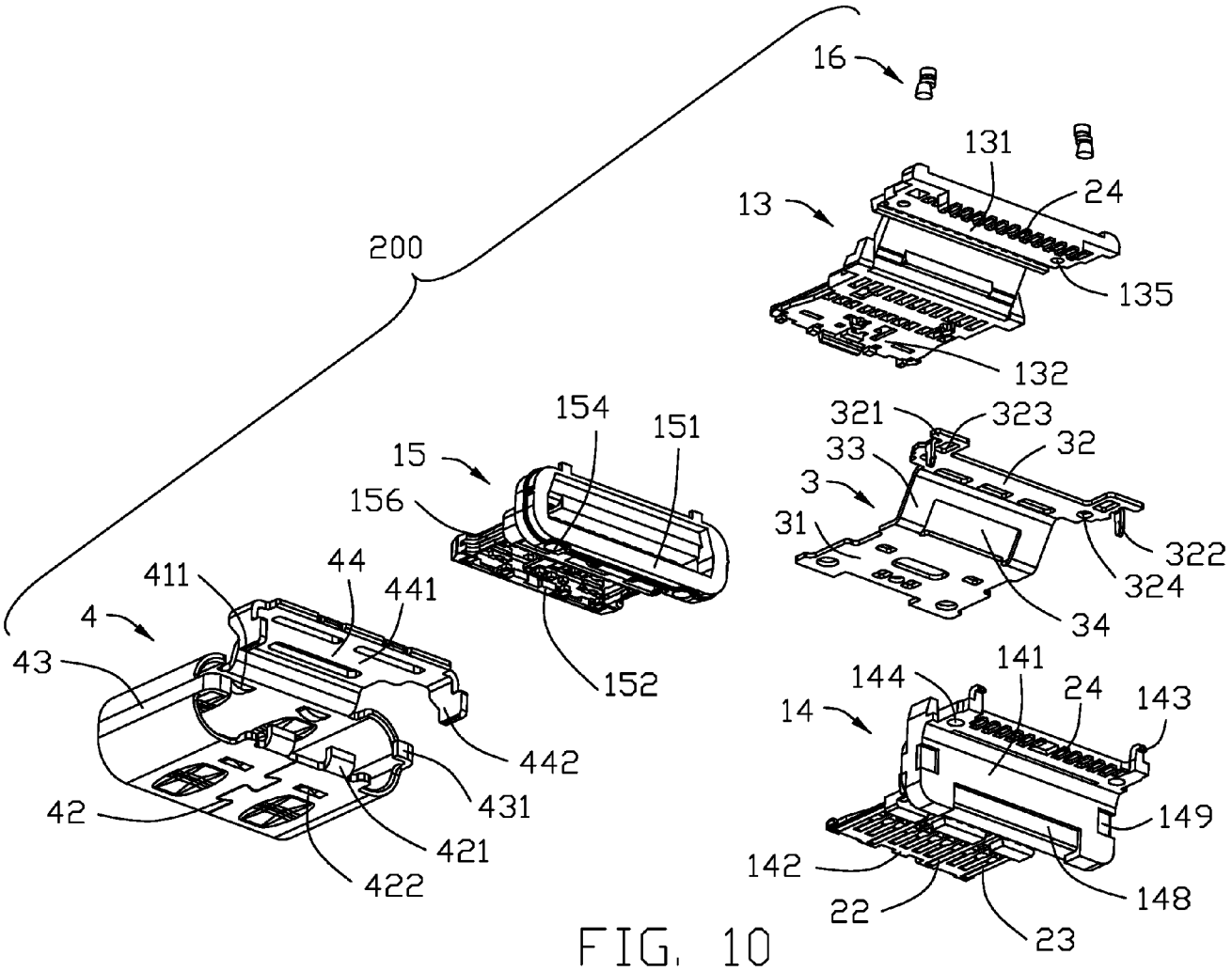
FIG. 10 is a view similar to FIG. 9 but from another perspective.

Referring specifically to FIGS. 9-10, in making the electrical connector 100, firstly, the contacts 2, the metal shielding plate 3, and the insulative housing 1 are assembled in a generally known manner.

The metal shielding plate 3 is clamped between the first insulator 13 and the second insulator 14, the pair of second locking portions 143 are locked with the pair of first locking portions 134, the clamping block 147 is clamped with the locking hole 136, and the holding block 133 is filled in the receiving space 146. The front portion 31 is clamped between the first tongue 132 and the second tongue 142 and extends laterally, the rear portion 32 is clamped between the first base 131 and the second base 141 so that the first mated holes 135, the second mated holes 144, and the third mated holes 324 are aligned in the vertical direction, respectively, and the through hole 34 receives the first insulator 13 and the second insulator 14 in contact with each other. The fixed pins 321 abut against a lower surface of the first base 131, the soldering pins 322 extend laterally between the first insulator 13 and the second insulator 14, and the positioning holes 323 are adapted for fitting of the second locking portions 143 and the first locking portions 134. The posts 16 fill the holes 135, holes 144, and holes 324.

The first insulator 13 and the second insulator 14 are insert molded with insulative materials to form the third insulator 15. The fixed groove 156 of the third insulator 15 corresponds to the front portion 31.

Referring specifically to FIGS. 7-8, the insulative housing 1 is arranged in the shielding shell 4 to form the receptacle connector 200. The shielding sheet 44 is disposed on the upper surface of the base portion 11. The fixed legs 442 are laterally surrounded by the insulative housing 1. The soldering pins 322 are attached to an inner surface of the fixed legs 442. The supporting surfaces 4421 of the fixed legs 442 are supported on a lower surface of the fixed pins 321. The pair of second bending parts 431 abut the pair of grooves 149. The first protrusions 411 are locked with the receiving grooves 153. The second protrusions 422 are locked with the recesses 154. The first bending parts 421 are locked with the notch 148.

The outer cover 5 is enclosed about the receptacle connector 200 so that a front surface of the outer cover 5 is generally aligned with a front surface of the shielding shell 4, or the front surface of the latter slightly extends beyond. A groove 551 is therefore defined between a front end of the shielding shell 4 and the front protrusion 55 of the outer cover 5 for accommodating the sealer 7. The rear sealer 6 may then be applied to seal a rear of the mating room 400.

Figure 4:
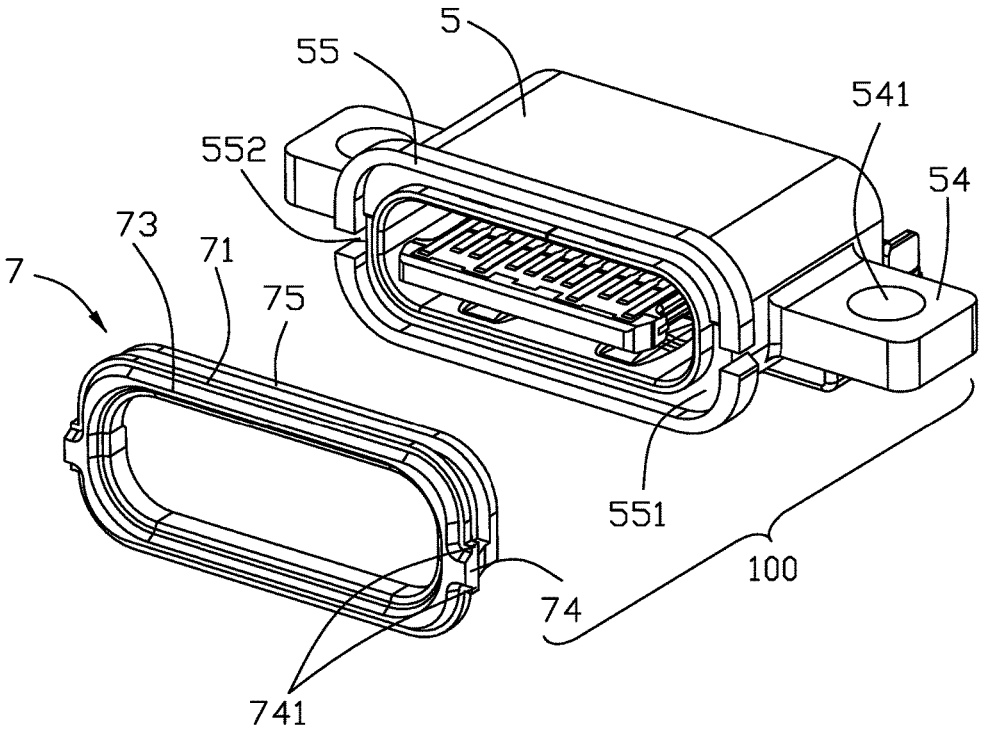
FIG. 4 is an exploded view of the electrical connector in FIG. 3.
Figure 11:
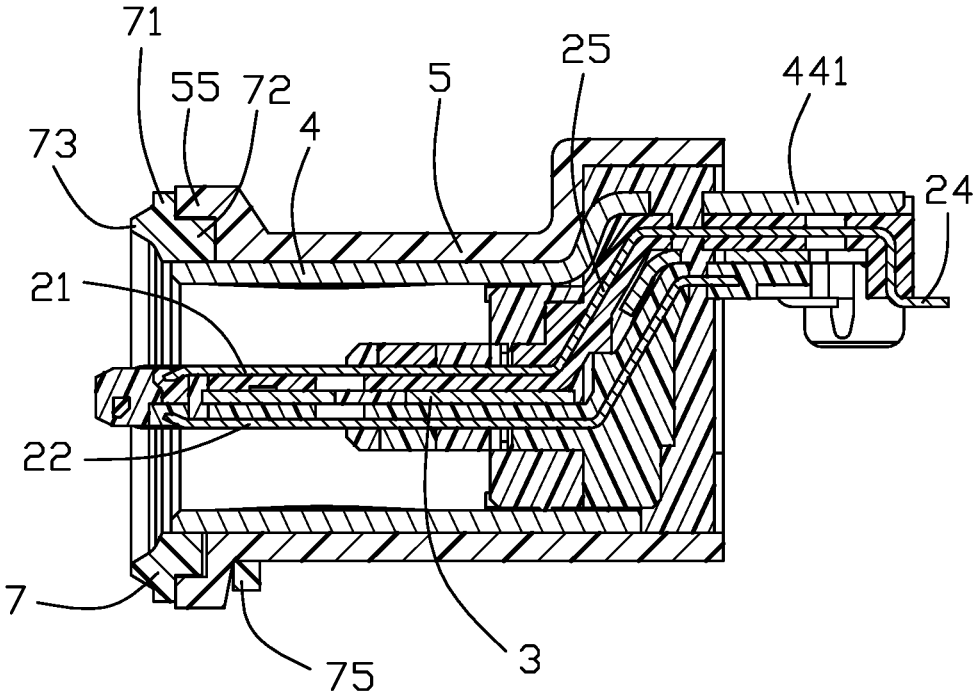
FIG. 11 is a cross-sectional view of the electrical connector taken along line A-A in FIG. 1.

Referring to FIGS. 4 and 11, when the sealer 7 is mounted in place, the first part 72 is disposed in the groove 551 while the base part 71 and the second part 73 are exposed outwardly of the groove 551, with the rear surface of the base part 71 abutting the front (end) surface of the protrusion 55, the connecting portions 74 are received in the slots 552, with the enlarged sections 741 also butting the front surface of the protrusion 55, and the securing portion 75 is firmly secured behind the protrusion, e.g., by the securing portion 75 abutting a rear of the protrusion 55. Notably, on one hand the sealer 7 efficiently seals the tiny gaps in the peripheral boundary interface between the shielding shell 4 and the outer cover 5 around the front end of the shell 4, and the securing portion 75 cooperates with the front main body of the sealer 7 to sandwich the protrusion 55 of the outer cover 5, thus assuring retention of the sealer 7 upon the outer cover 5 without risks of removal. On the other hand, the second part 73 may be rearwardly pressed by the panel of the enclosure, in which the connector is disposed, so as to have the sealer 7 deformed to enhance sealing of the gap between the outer cover 5 and the shielding shell 4.

In this embodiment the front sealer 7 is preformed before assembled to the outer cover 5 while the rear sealer 6 is formed by solidification within the outer cover 5 from a liquid form. Understandably, front sealer 7 may be formed in a way similar to that of the rear sealer 6. If doing so, the protrusion 55 may form additional inner recesses to communicate with the groove 551 so as to have the solidified sealer 7 equipped with the corresponding structures engagably embedded within the recesses for securing the sealer 7 in position within the groove 551 without risks of withdrawal. In this embodiment, the outer cover 5 is made either by over-molding with or injection-molding an insulator or via an MIM (Metal Injection Molding).

What is claimed is:

1. An electrical connector comprising:

an insulative housing having a base portion and a tongue portion;

a plurality of contacts affixed to the insulative housing and exposed to the tongue portion;

a metallic shielding shell enclosing the insulative housing and having a front end;

an outer cover enclosing the shielding shell and having a front protrusion; and a front sealer having a front main body, a rear securing portion, and a pair of connecting portions connected between the front main body and the rear securing portion; wherein a groove is defined between the front end of the shielding shell and the front protrusion of the outer cover; and the front main body is disposed in the groove and the rear securing portion is disposed behind the front protrusion of the outer cover; wherein the front protrusion of the outer cover has a pair of slots receiving the pair of connecting portions, respectively.

2. The electrical connector as claimed in claim 1, wherein the front main body is annular and the rear securing portion is U-shaped.

3. An electrical connector comprising:

an insulative housing having a base portion and a tongue portion extending forwardly from the base portion along a front-to-back direction;

a plurality of contacts affixed to the insulative housing and exposed to the tongue portion;

a metallic shielding shell enclosing the insulative housing and having a front end;

an outer cover enclosing the shielding shell and having a front protrusion; and a front sealer having a front main body;

a groove defined between the front end of the shielding shell and the front protrusion of the outer cover; wherein the front main body has a base part rearwardly abutting against a front end face of the front protrusion of the outer cover in said front-to-back direction, and a first part located behind the base part and disposed in the groove; wherein said outer cover forms a slot to receive said connection portion correspondingly.

4. The electrical connector as claimed in claim 3, further including means for securing the front sealer to the outer cover without risks of withdrawal.

5. The electrical connector as claimed in claim 4, wherein said means includes a rear securing portion cooperate with the front main body to sandwich the front protrusion therebetween in the front-to-back direction.

6. The electrical connector as claimed in claim 5, wherein said means further includes a connection portion linked between the front main body and the rear securing portion in the front-to-back direction.

7. The electrical connector as claimed in claim 5, wherein said rear securing portion extends with one half of a periphery of the outer cover while the front main body extends with a complete periphery of the shielding shell.

8. The electrical connector as claimed in claim 3, wherein said front main body further includes a second part forwardly extending beyond the base port opposite to the first part.

9. The electrical connector as claimed in claim 3, wherein said front sealer is preformed before assembled upon the outer cover and the shielding shell.

10. The electrical connector as claimed in claim 3, wherein said outer cover is metallic.

11. An electrical connector comprising:

an insulative housing having a base portion and a tongue portion extending forwardly from the base portion along a front-to-back direction;

a plurality of contacts affixed to the insulative housing and exposed to the tongue portion;

a shielding shell enclosing the insulative housing and having a front end;

an outer cover enclosing the shielding shell and having a front protrusion; and a front sealer having a front main body and a rear securing portion with at least one connection portion linked therebetween in the front-to-back direction; wherein the front main body cooperates with the rear securing portion to sandwich the front protrusion therebetween in the front-to-back direction so as to securely retain the front sealer to the front protrusion; and said outer cover forms a slot to receive the connection portion.

12. The electrical connector as claimed in claim 11, wherein the front sealer forwardly extends beyond both the outer cover and the shielding shell in the front-to-back direction.

13. The electrical connector as claimed in claim 12, wherein a front end of the tongue portion extends forwardly beyond the front sealer.

14. The electrical connector as claimed in claim 11, wherein a groove is formed between a front end region of the shielding shell and a front end region of the outer cover, and the front main body includes a first part received within the groove.

15. The electrical connector as claimed in claim 11, wherein the front main body includes a base part rearwardly abutting against a front surface of the outer cover.

16. The electrical connector as claimed in claim 11, wherein said rear securing portion extends with one half of a periphery of the outer cover while the front main body extends with a complete periphery of the shielding shell.

* * * * *